US008684771B2

(12) United States Patent
Bhosale

(10) Patent No.: US 8,684,771 B2
(45) Date of Patent: Apr. 1, 2014

(54) CONTACT CONSTRUCTION OF ELECTRICAL RECEPTACLE

(75) Inventor: Vikramsinh P. Bhosale, W. Babylon, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 266 days.

(21) Appl. No.: 13/292,510

(22) Filed: Nov. 9, 2011

(65) Prior Publication Data

US 2013/0115825 A1 May 9, 2013

(51) Int. Cl.
*H01R 33/00* (2006.01)

(52) U.S. Cl.
USPC ..... 439/682; 439/106

(58) Field of Classification Search
USPC ..... 439/106, 107, 535, 652, 682
See application file for complete search history.

(56) References Cited

U.S. PATENT DOCUMENTS

| | | | |
|---|---|---|---|
| 2,952,831 | A | 9/1960 | Ehrlich |
| 3,944,314 | A | 3/1976 | Weitzman et al. |
| 5,181,310 | A | 1/1993 | Josephson |
| 5,637,000 | A | 6/1997 | Osterbrock et al. |
| 5,975,925 | A | 11/1999 | Tiberio, Jr. |
| 6,595,810 | B1 | 7/2003 | Kenny |
| 6,926,543 | B2 | 8/2005 | Poh et al. |
| 7,140,887 | B2 | 11/2006 | Poh et al. |
| 7,355,117 | B2 | 4/2008 | Castaldo et al. |
| 7,820,909 | B2 | 10/2010 | Castaldo et al. |
| 7,909,664 | B2 | 3/2011 | Ilkhanov |
| 7,963,812 | B2 | 6/2011 | Ilkhanov |
| 2010/0304619 | A1 | 12/2010 | Joy |
| 2010/0304624 | A1 | 12/2010 | Montalbano et al. |
| 2011/0028011 | A1 | 2/2011 | Castaldo et al. |

FOREIGN PATENT DOCUMENTS

WO WO 2010/138235 A2 12/2010

OTHER PUBLICATIONS

"Locking Blade Devices" & "Straight Blade Devices", Leviton Cat. Book L-200, Catalog #T5820-W, Cover Page, pp. 267, 270 and p. 581, www.leviton.com (printed on Jan. 25, 2012).

*Primary Examiner* — Khiem Nguyen
(74) *Attorney, Agent, or Firm* — Carter, DeLuca, Farrell & Schmidt, LLP

(57) ABSTRACT

An electrical contact is provided for an electrical receptacle. The contact includes a main body, a first segment that is an extension of the main body and substantially parallel to the main body, a second segment substantially perpendicular to the main body and the first segment, a third segment substantially perpendicular to the second segment and substantially parallel to the main body and the first segment, a first wipe that extends from the first segment, a second wipe that extends from the second segment, and a third wipe that extends from the third segment.

15 Claims, 9 Drawing Sheets

CONTACT CONSTRUCTION OF ELECTRICAL RECEPTACLE

BACKGROUND

1. Technical Field

The present disclosure relates generally to an improved electrical contact construction of an electrical receptacle. In particular, the present disclosure relates to an electrical contact construction of an electrical receptacle designed for efficiency in manufacturing.

2. Description of Related Art

An electrical receptacle may be used for a variety of applications, including plugs that are configured for 15 amp operation and plugs that are configured for 20 amp operation. Conventionally, in a 15 amp plug, a phase blade is oriented parallel to a neutral blade, whereas in a 20 amp plug, the phase blade is oriented perpendicular to the neutral blade. Thus electrical receptacles are sometimes designed to accept blades that have different orientations. An electrical receptacle is provided with an internal phase contact that makes physical and electrical contact with the phase blade and electrically conducts between the blade and a host electrical system. The stability of the physical and/or electrical contact for one or both of the orientations may be compromised by a design that is configured to accept both orientations. Additionally, the shape and form of a phase contact that accepts both orientations may be complicated, use a large amount of material, and be difficult to manufacture.

Typically, electrical receptacles are provided with the capability of coupling to ground via a grounded metal box or a ground (or grounding) conductor commonly provided with non-metallic or armored cable. However, in certain instances, it may be desirable to minimize or eliminate electromagnetic interference (EMI), radio frequency interference (RFI), electrical noise or the like. This might be the case for sensitive electronic equipment where noise may interfere with the proper functioning of the equipment. One approach to achieve this (i.e., to achieve noise immunity) is to provide for a ground path which is isolated from other ground paths downstream of an electrical panel (i.e., the service entrance or a sub-panel). In other words, an isolated ground path is a ground path originating at an electrical panel of the system and terminating at an electrical device (such as a wiring device), where the ground path is isolated (i.e., electrically insulated) from all other ground paths between the electrical panel and the electrical device. In such an instance, electrical receptacles may be constructed such that the ground contact, which is configured to connect with a ground blade of a plug, is coupled to the isolated ground path. In addition, a typical receptacle may be provided with a metal mounting strap or yoke. If so, the mounting strap is required to be grounded as well. In this case, the mounting strap may be grounded via a grounded metal box. As such, the ground contact is electrically isolated from the mounting strap (normally the ground contact is electrically bonded to the mounting strap).

SUMMARY

The present disclosure is directed to an electrical contact for an electrical receptacle, the electrical contact. The electrical contact includes a first segment that is the an extension of the main body and substantially parallel to the main body, a second segment substantially perpendicular to the main body and the first segment, a third segment substantially perpendicular to the second segment and substantially parallel to the main body and the first segment, a first wipe that extends from the first segment, a second wipe that extends from the second segment, and a third wipe that extends from the third segment.

The present disclosure is also directed to an electrical receptacle assembly having an electrical contact having at least two wipes for receiving a blade of an electrical plug that is inserted in the electrical receptacle assembly, and a base adapted and configured to receive the electrical contact and to interfere with deflection of a wipe of the at least two wipes for substantially limiting movement of the wipe during insertion of the blade.

The present disclosure is further directed to an electrical contact for an electrical receptacle, the electrical contact having a main body, a first segment that is the an extension of the main body and substantially parallel to the main body, a second segment coupled to the first segment and substantially perpendicular to the main body and the first segment, and a third segment coupled to the second segment and substantially perpendicular to the second segment and substantially parallel to the main body and the first segment. The electrical contact further includes a first wipe that extends from the first segment, a second wipe that extends from the second segment, and a third wipe that extends from the third segment. The electrical contact further includes a first bend disposed between the first and second segments and a second bend disposed between the second and third segments. The first and second bends are 90 degrees. Additionally, the first segment is bifurcated into an upper arm and a lower arm that branch from the main body. The upper arm extends from the main body and bends toward the third segment. The first wipe extends from the upper arm, and the lower arm is connected to the second segment.

In an alternate embodiment the disclosure is directed to an electrical receptacle assembly for electrically conducting between a host electrical system and a load. The electrical receptacle assembly includes a strap, a base, at least one electrical contact, and a ground contact. The strap is formed of an electrically conductive material and has an elongated bottom wall. The base is formed of an electrically non-conductive material, wherein the base has a bottom face seated on the bottom wall of the strap and an opposing open top face having a plurality of compartments defined by exterior and interior walls. The electrical contacts are adapted and configured for being seated within the base. The ground contact is formed of a conductive material. The ground contact is adapted and configured to electrically couple with a ground. Additionally, the ground contact and the base are adapted and configured for the ground contact to be placed via the open top face of the base for being received by one or more compartments of the base.

In another alternate embodiment the present disclosure is directed to a ground contact of an electrical receptacle. The ground contact includes a body that is formed of a conductive material and is adapted and configured to fit within a compartment of a base of the electrical receptacle so that a bottom surface of the body rests on a floor of the base. The ground contact further includes at least one set of at least two wipes coupled to the body and formed of a conductive material. Each set of wipes is adapted and configured to physically receive and electrically contact a blade of an electrical plug coupled to a load. An electrically conductive protrusion extends from the bottom surface of the body for electrically contacting a surface positioned below the base.

In a further alternate embodiment the present disclosure is related to a method for assembling an electrical receptacle. The electrical receptacle includes a strap formed of a conductive material and adapted and configured to be installed in a host structure, a base having at least first, second, and third open faced compartments each having a floor, first and second electrical contacts and a ground contact adapted and configured to electrically couple to a ground and having a protrusion that extends from a bottom surface of the ground contact.

The method includes seating the base on a bottom wall of the strap so that the bottom surface of the base is seated on the strap, placing the first and second electrical contacts in the respective first and second compartments of the base by loading them via the associated open face, and placing the ground contact in the third compartment of the base by loading it via the associated open face so that a bottom surface of the ground contact rests on the floor of the third compartment. The protrusion optionally extends through a first aperture provided in the floor of the base and physically and electrically contacts the strap.

Other features of the presently disclosed electrical contact and electrical receptacle will become apparent from the following detailed description, taken in conjunction with the accompanying drawings, which illustrate, by way of example, the presently disclosed electrical receptacle.

BRIEF DESCRIPTION OF THE DRAWINGS

Various embodiments of the present disclosure will be described below with reference to the figures, wherein.

DETAILED DESCRIPTION

Figure 1:
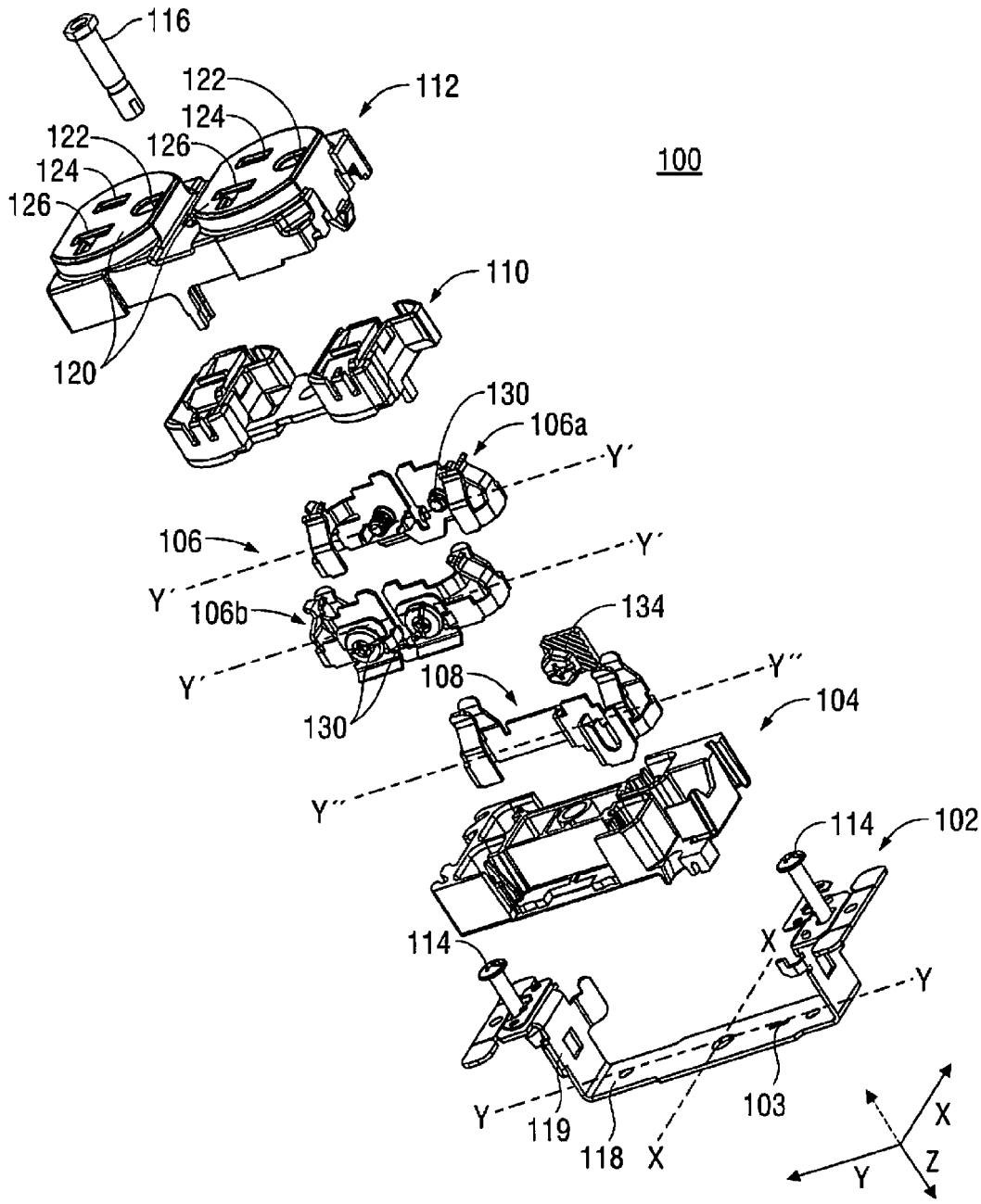
FIG. 1 is a perspective exploded view of an exemplary electrical receptacle in accordance with the present disclosure.

Referring now to the drawing figures, in which like reference numerals identify identical or corresponding elements, the electrical receptacle in accordance with the present disclosure will now be described in detail. With initial reference to FIG. 1, an exemplary electrical receptacle in accordance with the present disclosure is illustrated and is designated generally electrical duplex receptacle 100.

The Electrical Duplex Receptacle Assembly

Electrical duplex receptacle 100 is a duplex receptacle having first and second outlets, each outlet adapted and configured to receive a 15 amp or 20 amp electrical plug having three blades. Electrical duplex receptacle 100 includes an exemplary conductive strap 102. Strap 102 may be electrically coupled to a first ground, e.g., earth via any conventional method such as mounting to a grounded metal box or connection to a grounding conductor. Base 104 is seated on a bottom wall of the strap, and in the present example within a cavity formed by the U-shape of strap 102. Two exemplary electrical contacts 106 (including a phase contact **106*a* and a neutral contact 106*b*) and ground contact 108 are seated within base 104. Optional tamper resistant mechanism 110 is seated over base 104 after the contacts are placed therein. Cover 112 is assembled over tamper resistant mechanism 110 and secured with center bushing 116. In an alternative embodiment center bushing 116 may be replaced with another variety of fastener, such as a U-shaped clamp. Fasteners 114 secure strap 102** to a structure, e.g., a wall, of a host-structure, such as a building.

The strap 102 has an elongated bottom wall 118 having a longitudinal axis y, a transverse axis x, and opposite ends from which extend first and second walls 119 along a z axis, which together form the "U" shape of strap 102. Phase contact **106*a* and neutral contact 106*b* and ground contact 108** have longitudinal axes y' and y", respectively, which are parallel to axis y.

Operation of the Receptacle

Male blades of an electrical plug are received via one of outlets 120 provided on cover 112. Each outlet has three apertures adapted and configured for receiving one of the three male blades, including ground aperture 122 for receiving a ground blade, neutral aperture 124 for receiving a neutral blade, and phase aperture 126 for receiving a phase blade. The phase and neutral blades have a rectangular cross-section. Aperture 124 is rectangular in shape for receiving a neutral blade that has a first orientation that is substantially parallel to longitudinal axis y' of electrical contacts 106. Aperture 126 has a "T" shape for receiving a phase blade that may have a first or second orientation, wherein the first orientation is substantially parallel to longitudinal axis y', and the second orientation is perpendicular longitudinal axis y'. Typically the first orientation corresponds to a 15 amp plug and the second orientation corresponds to a 20 amp plug.

The blades are received through tamper resistant mechanism 110 and electrically contact the phase contact **106*a* and neutral contact 106*b* and ground contact 108. Tamper resistant mechanism 110 is illustrated and described in U.S. patent application Ser. No. 12/981,745, entitled "ILLUMINATED RECEPTACLE," and filed Dec. 30, 2010, which is hereby incorporated by reference. Tamper resistant mechanism 110 may be optionally omitted from receptacle 100. The ground blade electrically contacts the ground contact 108. The phase blade electrically contacts a phase contact 106*a* that is electrically coupled to the phase of a supply voltage as described further below. The neutral blade electrically contacts the neutral contact 106*b*** that is electrically coupled to the neutral of the power supply as described further below.

Configuration of the Base

Figure 2:
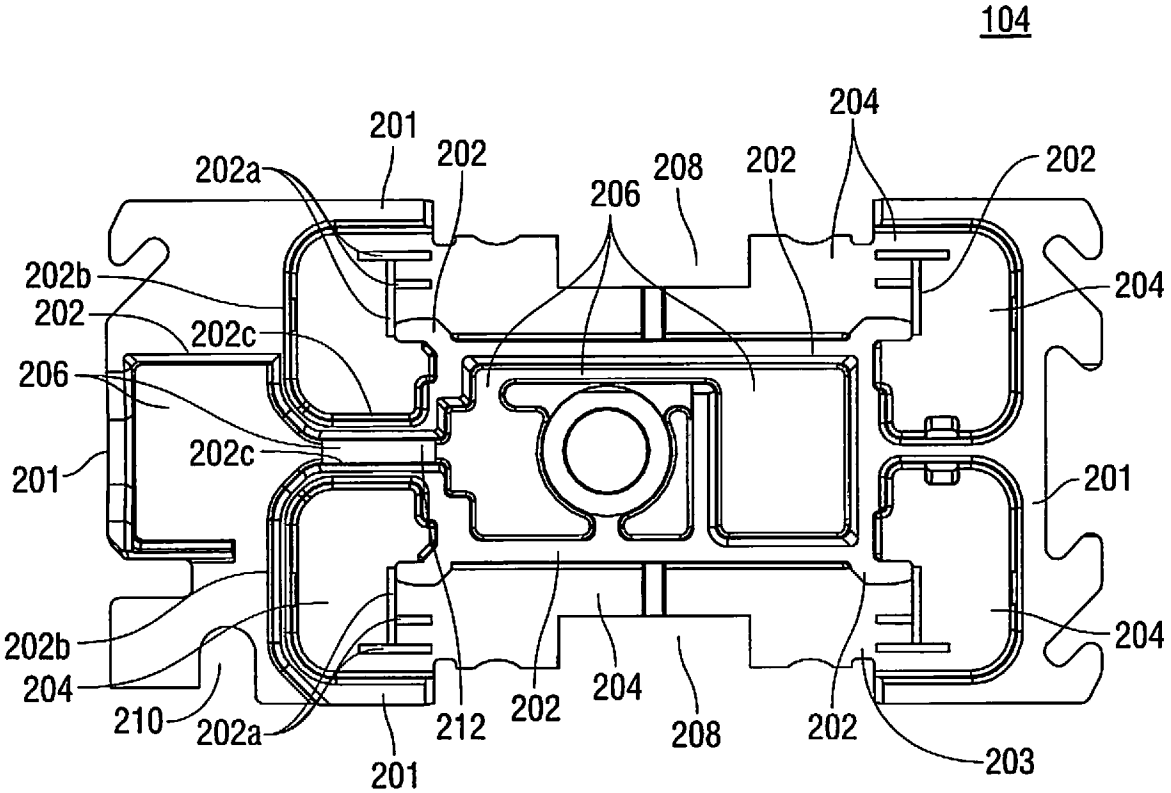
FIG. 2 is a top view of a base of the electrical receptacle shown in FIG. 1 and in accordance with the present disclosure.

FIG. 2 shows base 104 in greater detail. Base 104 is provided with an open top face and a plurality of compartments defined by exterior walls 201, interior walls 202, and floor 203. Side compartments 204 are each shaped and configured so that one of electrical contacts 106 can be dropped into the corresponding side compartment 204 and be seated therein, resting on the floor 203. Center compartment 206 is shaped and configured so that ground contact 108 can be dropped into the center compartment 206 and be seated therein, resting on the floor 203. Exterior walls 201 define openings 208 and 210. Openings 208 provide external access to the phase and neutral contacts. A contact screw pair 130 is fastened to each of the phase contact 106*a* and neutral contact 106*b* via openings 208. A first phase contact screw pair 130 is electrically coupled to a phase of a supply voltage and a second neutral contact screw pair 130 is electrically coupled to a neutral of a supply voltage, wherein the voltage-lines are provided from a host electrical system, e.g., an associated panel. Opening 210 provides external access to the ground contact 108. A ground contact screw 134 is fastened to the ground contact 108 via opening 210. The ground contact screw 134 is electrically coupled to a second ground, e.g., a ground of the host electrical system, such as the panel.

Configuration of the Electrical Contacts

Figure 3:
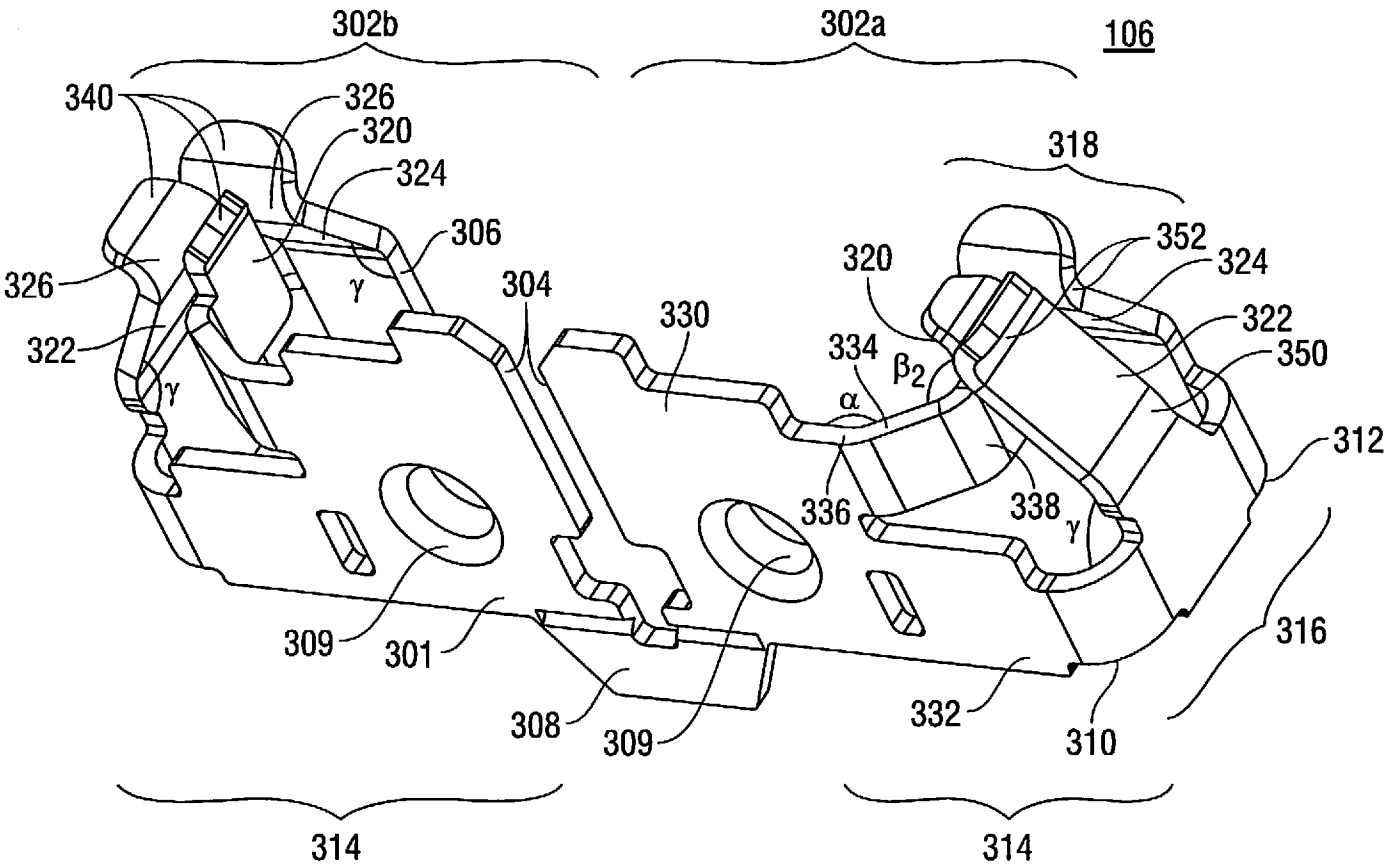
FIG. 3 is a perspective view of an exemplary contact of the electrical receptacle shown in FIG. 1 and in accordance with the present disclosure.
Figure 4:
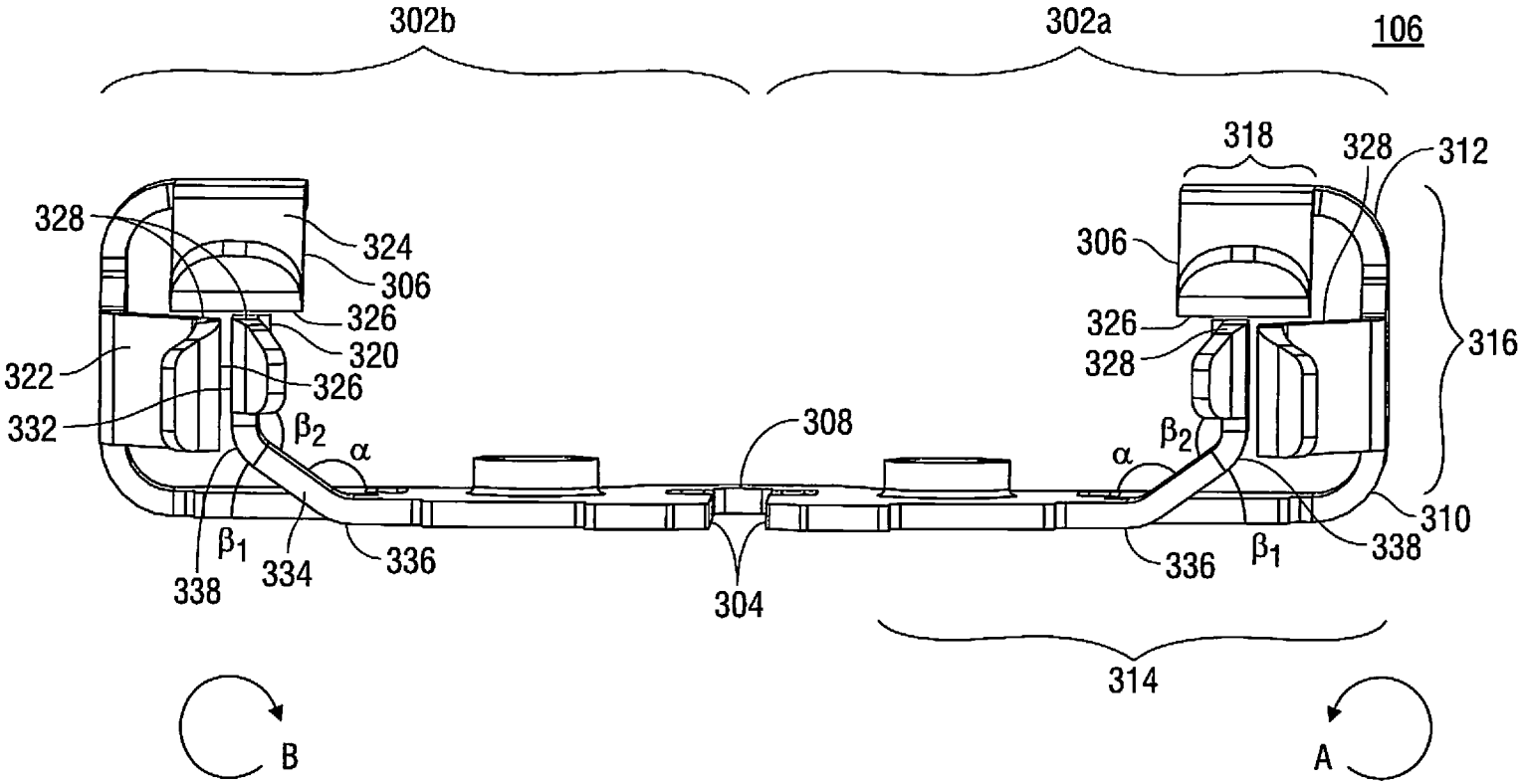
FIG. 4 is a side view of the contact shown in FIG. 3 and in accordance with the present disclosure.

FIGS. 3 and 4 show an electrical contact 106 (phase or neutral) formed of a conductive material and having first and second elongated portions 302*a* and 302*b*, respectively, each elongated portion 302*a*, 302*b*, having a proximal end 304, a distal end 306, an outer face 301, and an inner face 303. The proximal ends 304 are coupled to each other via a bridge member 308. The bridge member 308 is also known as a break-off tab in the electrical industry and allows for the two elongated portions to be isolated from one another if bridge member 308 is broken off and removed. This is done when one wishes each outlet of the receptacle to be connected to a different circuit.

Each elongated portion 302*a*, 302*b* has a main body 330 that is removably connected to the bridge member and has an opening, such as aperture 309, for receiving and electrically contacting a contact screw 130. Each elongated portion 302*a*, 302*b* further includes a first segment 314, a second segment 316, and a third segment 318. First segment 314 extends from the main body 330, substantially parallel to the main body 330, and bifurcates into a lower arm 332 and an upper arm 334. Lower arm 332 is substantially parallel to the main body 330 and extends to second segment 316. Upper arm 334 extends from main body 330 toward third segment 318 bending at bend 336 by acute angle $\beta_1$ and forming an obtuse angle $\alpha$. Second segment 316 extends form first segment 314, substantially perpendicular to first segment 314 and main body 330. Third segment 318 extends from second segment 316, substantially perpendicular to second segment 316 and substantially parallel to first segment 314 and main body 330.

Bend 310 is disposed between first segment 314 and second segment 316. Bend 310 may be formed as an angled or a rounded corner, and is substantially 90 degrees. Bend 312 is disposed between second segment 316 and third segment 318. Bend 312 may be formed as an angled or a rounded corner, and is substantially 90 degrees. Preferably, bends 310 and 312 are both 90 degrees.

At least one and preferably all of first wipe 320, second wipe 322, and third wipe 324, are formed of a conductive material. The first, second, and third wipes 320, 322, 324 extend at an angle from the first segment 314, second segment 316, and third segment 318, respectively. First segment 314's upper arm 334 extends to first wipe 320. First and second wipes 320 and 322 each have a contact face 326 and a contact edge 328, and third wipe 324 has a contact face 326. In the current example, the first and second elongated portions 302*a*, 302*b* are symmetrical relative to one another, but the disclosure is not limited thereto.

A combination of the wipes 320, 322, 324 associated with the first elongated portions 302*a* of the two electrical contacts 106 are associated with the first receptacle of the electrical duplex receptacle 100, and a combination of the wipes 320, 322, 324 associated with the second elongated portions 302*b* of the two electrical contacts 106 are associated with the second receptacle of the electrical duplex receptacle 100. When the blades of a male plug are inserted into the first electrical receptacle, the line and neutral blade are each received and electrically contacted by a combination of the wipes 320, 322, 324 of one of the phase contact 106*a* and neutral contact 106*b*. The neutral blade is oriented substantially parallel to the longitudinal axis y'. Typically, in a 15 amp plug, the line blade is oriented in the first orientation that is substantially parallel to the axis y', and in a 20 amp plug, the line blade is oriented in the second orientation that is substantially perpendicular to the axis y'.

The configuration of the first, second, and third segments, 314, 316, and 318 and of first, second, and third wipes 320, 322, and 324 provides advantages, including simplifying the manufacturing process and reducing the amount of material required to manufacture the electrical receptacle 100. More specifically, relative to a conventional electrical receptacle, such as an electrical receptacle described in U.S. Patent Application No. 2010/0304619, the width of the blank from which the electrical receptacle 100 is manufactured can be reduced. Actual measurements have shown that the width of the blank used can be reduced by 3%. Additionally, steps in the tooling process are simplified and the number of steps is reduced.

When the line blade is oriented in the first orientation, the first wipe 320 and the second wipe 322 receive and electrically contact the line blade between their respective contact faces 326. When the line blade is oriented in the second orientation, the contact face 326 of third wipe 324 electrically contacts the line blade and compresses it against the contact edge 328 of the first wipe 320 and the contact edge 328 of the second wipe 322. Thus, regardless of the orientation of the blade received, first wipe 320 cooperates with at least one of second and third wipes 322, 324.

Configuration of the Wipes of the Electrical Contacts

First wipe 320 extends inwardly towards the other wipes 322, 324 from upper arm 334 at bend 338 by an angle $\beta_2$ and further extends substantially straight up in the z direction. The sum of angles $\beta_1$ and $\beta_2$ is approximately 90 degrees. Second wipe 322 extends from second segment 316, bending at bend 350 at an acute angle $\gamma$ in the z direction and inwardly towards first wipe 320. Third wipe 324 extends from third segment 318, bending at bend 350 at an acute angle $\gamma$ in the z direction and inwardly towards first wipe 320 and second wipes 322. Contact faces 326 of first wipe 320 and second wipe 322 are substantially parallel to and spaced from one another. Contact face 326 of third wipe 324 is normal to the contact faces 326 of first wipe 320 and second wipe 322, and is further substantially parallel to and spaced from their respective contact edges 328. The distal ends of each of the wipes 320, 322, 324 include a lip 340 that bends slightly away at bend 352 from the other wipes to guide and ease insertion of blade between the wipes 320, 322, and 324.

As described above, a combination of the first, second, and third wipes 320, 322, and 324 receive and electrically contact a conductive blade that is inserted in the corresponding electrical receptacle. In one embodiment, when the blade is received it is physically contacted by the first, second, and third wipes 320, 322, and 324. The blade can be received in either the first or second orientation. The second and third wipes 322, 324 are adapted and configured to deflect when receiving and electrically contacting the conductive blade. Deflection of first wipe 320 is limited by a structure, such as a wall or a rib of base 104 so that the deflection is prevented or restricted during insertion of a conductive blade.

During insertion of the conductive blade, the base 104 substantially constrains movement of wipe 320, but does not substantially constrain movement of wipes 322 or 324. In other words, the base 104 is configured and adapted to limit movement of wipe 320 more than it limits movement of the other two wipes 322 and 324. The difference in the amount of movement allowed for wipes 322 and 324 relative to wipe 320 is significant and substantial. In one example, the difference in movement is at least two fold. In another example, the base 104 constrains deflection of wipe 320, but does not constrain deflection of wipes 322 and 324 during insertion of the conductive blade.

More specifically, with further reference to FIG. 2, when phase contact 106*a* or neutral contact 106*b* is placed in base 104, inner walls 202*a* are positioned closely behind first wipe 320 and limit or prevent potential deflection of first wipe 320. Inner walls 202*a* herein include at least one wall or at least one rib attached to the at least one wall. Inner walls 202*a* contact first wipe 320 either while first wipe 320 is stationary or deflects, albeit with a small amount of deflection. In comparison, inner walls 202*b* and 202*c* are positioned further behind second and third wipes 322, 324, respectively, and do not limit deflection thereof.

The height of inner walls 202*a* may be chosen according to design choice. The height may be selected to be as high as or higher than lip 340, providing a higher degree of deflection restriction. Alternatively, the height may be selected to be lower than lip 340, providing a selectable degree of deflection restriction, but wherein the degree of deflection is less than that of second and third wipes 322, 324. Similarly, the proximity of the inner walls 202*a* to first wipe 220 may be selected to for achieving a desired degree of limitation to the deflection of first wipe 220. Deflection of the first wipe 320 is thus restricted by a selected amount so that it is less than that of the second and third wipes 322, 324.

Improved robustness and improved electrical contact is achieved via the limited deflection of first wipe 320 in cooperation with the flexibility of second and third wipes 322, 324. Since second and third wipes 322, 324 are flexible, they deflect to allow for the insertion of a conductive blade and further provide a biasing force against the blade by pushing it against the face 326 or edge 328 of first wipe 320. First wipe 320, due to the restriction of its deflection, reciprocates against the biasing force and forms a superior electrical contact having improved consistency and predictability. Due to the improved robustness, in comparison to a conventional electrical contact for which deflection is not restricted, improved electrical contacts 106 may be formed of a material having a reduced thickness, or alternatively, having reduced hardness.

Configuration of the Ground Contact and its Placement within the Base

Figure 5:
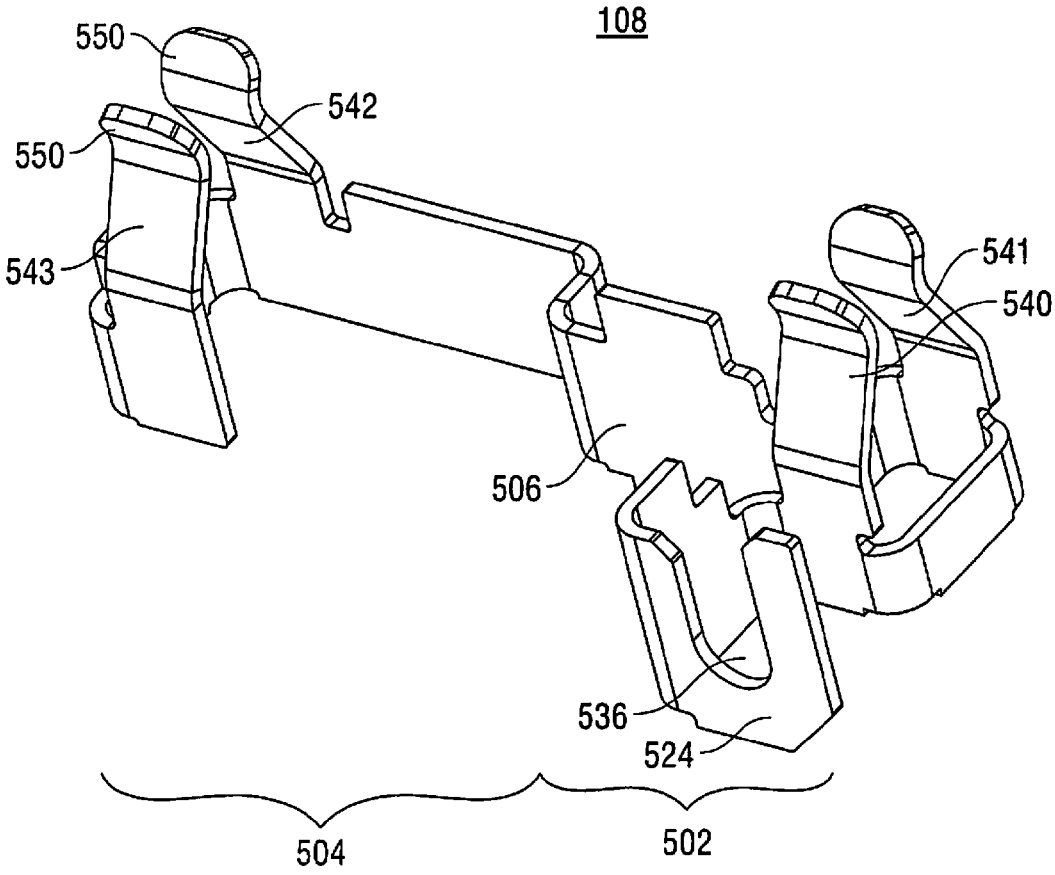
FIG. 5 is a perspective view of an exemplary ground contact of the electrical receptacle shown in FIG. 1 and in accordance with the present disclosure.
Figure 6:
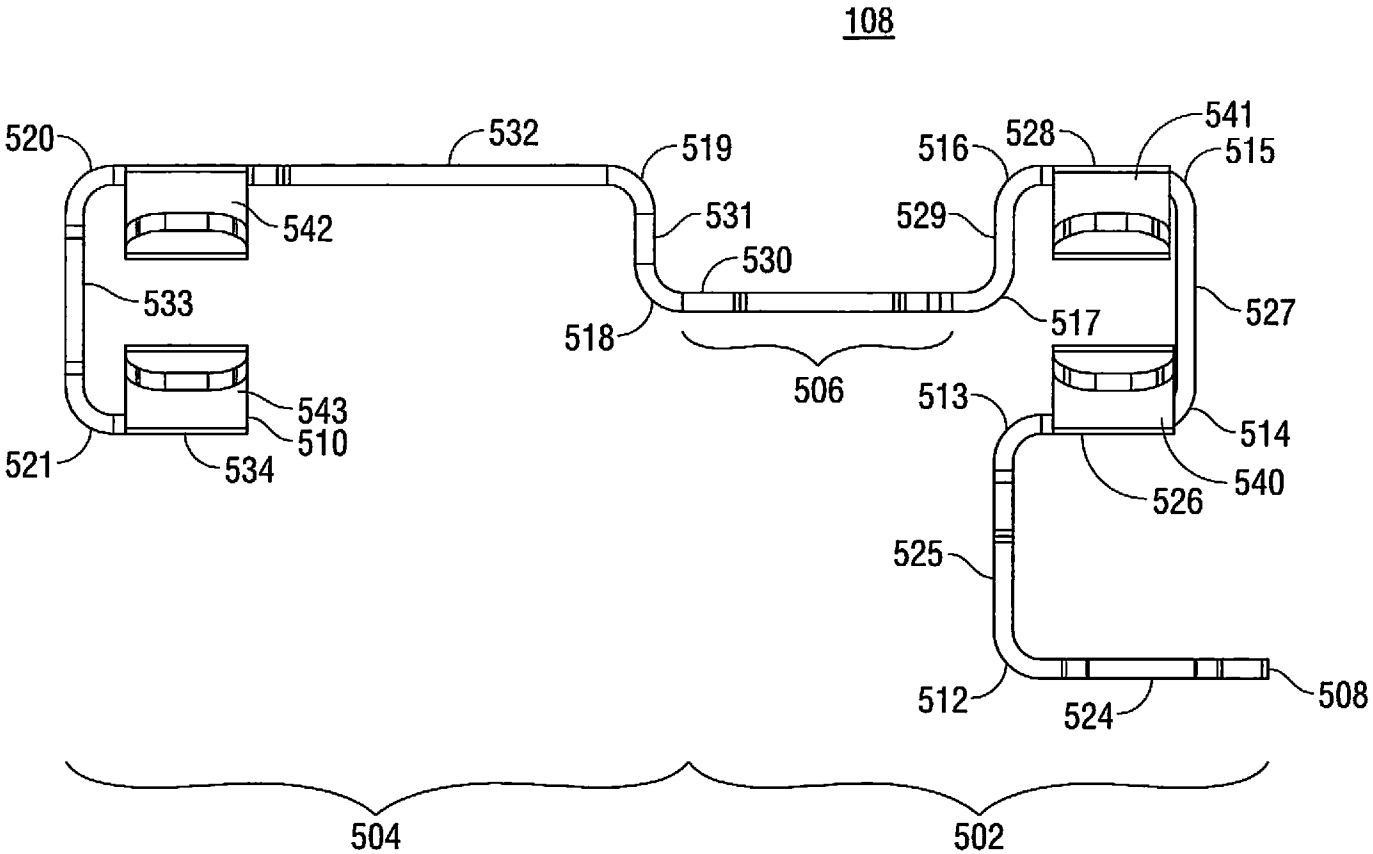
FIG. 6 is a top view of the ground contact shown in FIG. 5 and in accordance with the present disclosure.
Figure 7:
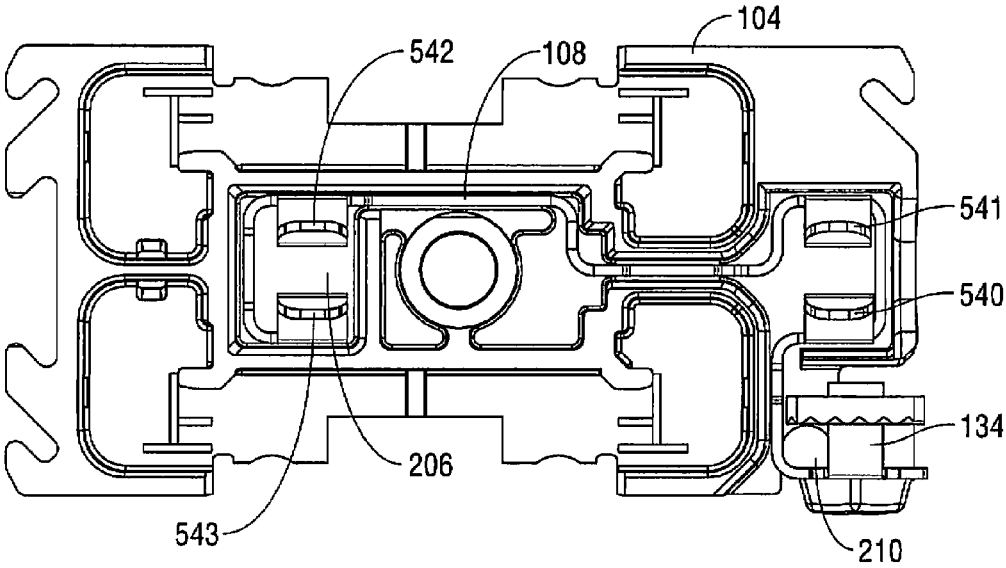
FIG. 7 is a top view of the base shown in FIG. 2 having the ground contact shown in FIG. 6 seated therein, in accordance with the present disclosure.

FIGS. 5-7 show ground contact 108 and its placement within base 104. Ground contact 108 is formed of a conductive material and includes a body having first and second portions 502 and 504 coupled via mid-section 506. Each portion 502 has a plurality of segments defined by a plurality of bends. The bends and segments are configured so that the ground contact 108 fits within compartments defined by inner walls 202 of base 104. The shape, position, and configuration of the compartments and inner walls 202 of base 104 as well as the segments and bends of portions 502 and 504 are not limited to those illustrated in the FIGS. 5-7, but they are complementary in that the ground contact 108 can be placed into the associated compartments of base 104 by simply dropping the ground contact 108 into base 104 via the open face of the base 104. When ground contact 108 is placed into the base 104 it sits on the floor 203 of the base 104.

In the current example, the ground contact 108 includes first and second distal ends 508 and 510; bends 512, 513, 514, 515, 516, 517, 518, 519, 520 and 521; and segments 524, 525, 526, 527, 528, 529, 530, 531, 532, 533, and 534. Segment 530 includes mid-section 506. In the current example, segment 530 is stiffer than the other segments and than the wipes described below. Portion 524 is provided with an opening 536 for receiving and electrically contacting ground contact screw 134.

Configuration of the Wipes of the Ground Contact

Segments 526, 528, 532, and 534 are provided with wipes 540, 541, 542, and 543, respectively. Wipes 540-543 each extend upward from their respective associated segments at an acute angle in the z direction and inwardly towards one another similar to the second and third wipes 322, 324 of electrical contacts 106. The flexibility of wipes 540-543 is similar to that of the second and third wipes 322, 324 of electrical contacts 106. Additionally, each of the ground contact's wipes 540-543 is provided at its top with a lip 550 similar to lip 340 of second and third wipes 322, 324 of electrical contacts 106. Wipes 540 and 541 oppose one another and form a first pair that is associated with first portion 502 and wipes 542 and 543 oppose one another and form a second pair that is associated with second portion 504. Each pair of wipes is configured to receive and electrically contact a ground blade of a male plug which was inserted via aperture 122 of the cover 112. Lip 550 bends slightly away from the opposing paired wipe to guide and ease insertion of the ground blade between the wipes. When the wipes receive the ground blade they deflect to accommodate the blade and once the ground blade is received the wipes of each pair apply opposing biasing forces.

Assembly of the Electrical Receptacle

Once the ground contact 108 is formed, it can be automatically assembled without human intervention by dropping the ground contact 108 into the associated compartments in base 104 as shown in FIG. 7. Additionally or alternatively, the electrical duplex receptacle 100 may be assembled or reassembled manually at any time up to installation. This is done, even at installation, by seating base 104 within strap 102, placing the electrical contacts 106 and ground contact 108 in base 104, placing tamper resistant mechanism 110 over base 104, covering the assembly with cover 112, and securing the assembled components with center bushing 116.

Ground Contact's Selectable Isolated Dual Grounding or Single Grounding

Figure 8:
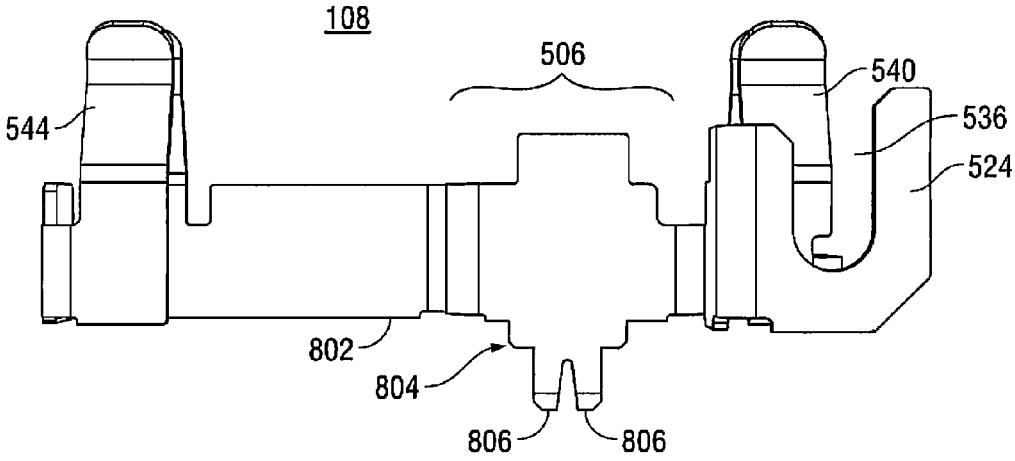
FIG. 8 is a side view of the ground contact shown in FIG. 5 and in accordance with the present disclosure.
Figure 9:
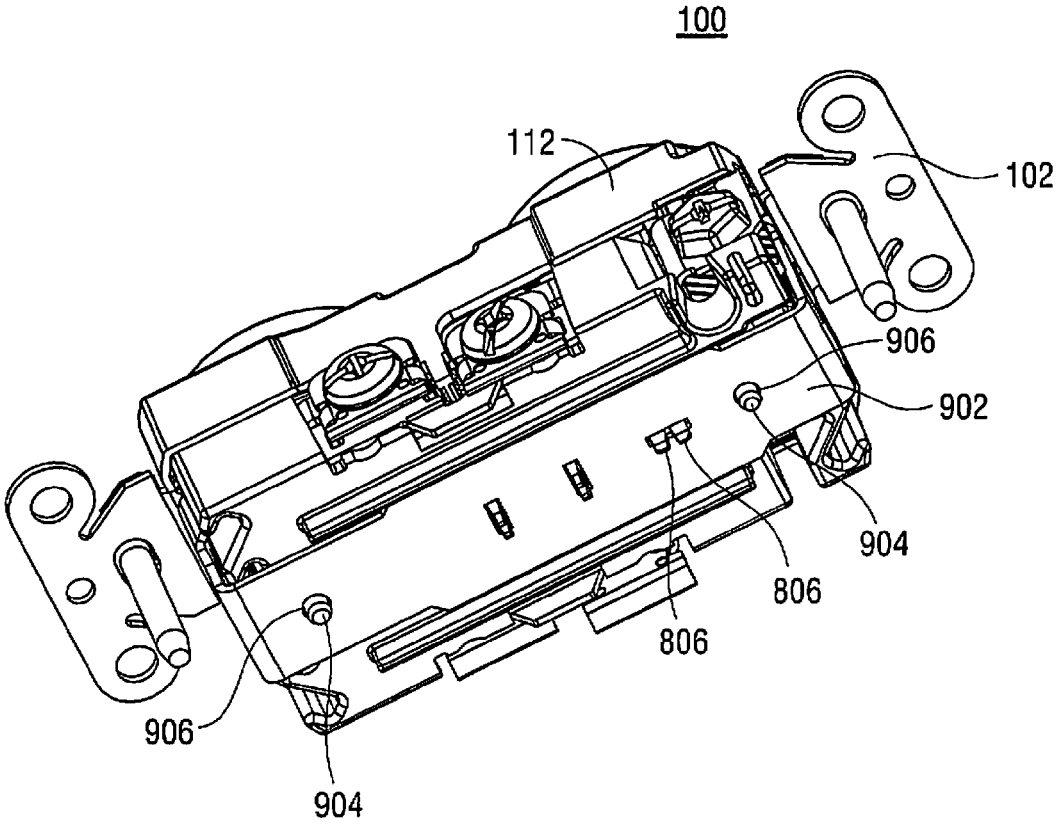
FIG. 9 is a bottom, perspective view of the electrical receptacle shown in FIG. 1 in an assembled configuration and in accordance with the present disclosure.

With reference to FIGS. 8-9, ground contact 108 is provided with an electrically conductive protrusion 804 that protrudes from a bottom surface 902 of the center portion 506. The protrusion 804 is deformable, including being removable. In the present example, the protrusion 804 includes two or more fingers 806 that are flexible and can be bent, or alternatively can be broken off. A first aperture 212 is formed in the floor 203 of center compartment 206 of base 104 (see FIG. 2). Additionally, a second aperture 103 is formed in the bottom wall 118 of the strap 102 (see FIG. 1). When the ground contact 108 is seated in the center compartment 206 of the base 104 the protrusion 804 extends through first aperture 212 and through the second aperture 103 so that it extends through strap 102. The protrusion 804 can be deformed to make a good physical contact and electrical connection with the strap 102. Once deformed, the protrusion 804 may function to secure the ground contact 108 to the strap 102.

As shown in FIG. 9, in the present example, when the ground contact 108 is seated in the base 104 and the base 104 is assembled with the strap 102, the fingers 806 extend through first and second apertures 212 and 103 and extend beyond the bottom surface 902 of the strap 102. The fingers 806 in combination have an inverted "V" shape that fits well through apertures 212 and 103. The fingers 806 may be bent to spread out relative to one another so that they contact the bottom surface 902 of the strap 102. When the fingers 806 contact the bottom surface 902 of the strap 806 there is electrical connectivity between the ground contact 108 and the strap 102. Additionally, the fingers 806 may engage the bottom surface 902 of the strap for securing the ground contact to the strap 102.

Alternatively, fingers 806 may manually be removed (e.g., by hand or by using a manual tool to break off the fingers 806) from the ground contact 108. The fingers 806 may be adapted and configured (e.g., scored) to facilitate breaking them off from the ground contact 108. The depth of scoring is controlled such that the fingers 806 only break off when intended to by the user. When the fingers 806 are broken off and the electrical duplex receptacle 100 is assembled, including seating center contact 108 within the base 104 and assembling the base with strap 102, the ground contact 108 is electrically isolated from the strap 102. In this case, there is no conductive protrusion 804 to extend between the ground contact 108 and the strap 102. The base 104 is nonconductive and electrically isolates the ground contact 108 and the strap 102. Also shown are nonconductive protrusions 904 that fit through apertures 906 to stabilize and hold platform 104 within base 102.

Accordingly, ground contact 108 may selectively be electrically coupled to strap 102 or electrically isolated from strap 102, depending on whether or not the fingers 806 are removed before placing the ground contact 108 in base 104. Ground contact 108 couples to at least one ground by electrically coupling with ground contact screw 134. Therefore, when ground contact 108 is electrically coupled to strap 102 it is electrically coupled to two distinct grounds, yet when ground contact 108 is electrically isolated from strap 102 it is electrically coupled to a single ground. Thus, electrical duplex receptacle 100 may selectively have traditional grounding (i.e., non-isolated ground) or isolated grounding using the same set of components. Selection is performed by deforming protrusion 804, e.g., by removing the fingers 806 from ground contact 108. Since the ground contact 108 can easily be assembled by simply placing or dropping it into the base 104, selection of single or dual grounding can be made at any time at which the electrical duplex receptacle 100 is assembled or re-assembled, including the point in time at which the electrical duplex receptacle 100 is installed for use. Accordingly, the top-loading design of contact 108 has several advantages, including ease of assembly, ease of manufacture, and selectable isolation from strap 102 at installation, The protrusion 104 is not limited to the structure or function of the example shown and other embodiments are envisioned. The present disclosure encompasses embodiments that include other structural configurations of base 104, such as a biased, foldable, or telescopic structure that has a first position in which it can protrude through base 104 and electrically contact strap 102, and a second position in which it is biased, folds or contracts so that it does not protrude through base 104 to electrically contact strap 102 but is electrically isolated from strap 102.

Figure 10:
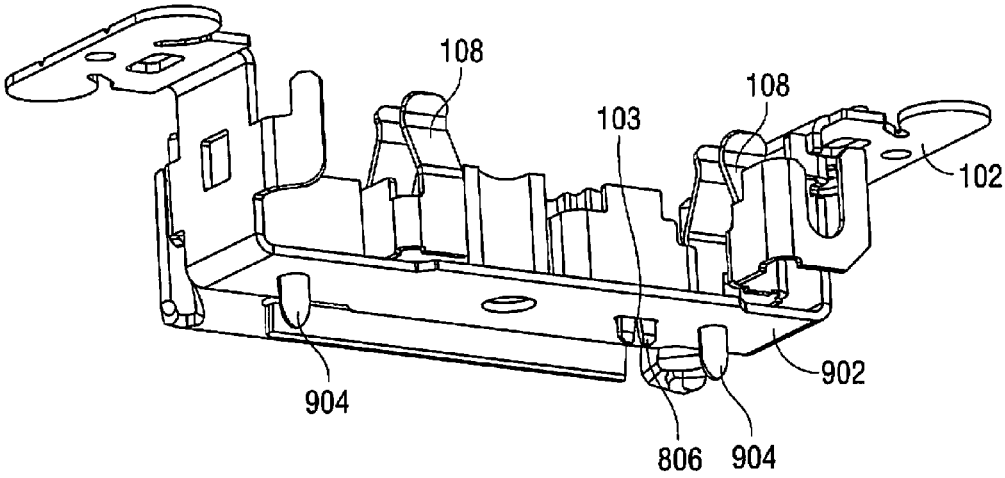
FIG. 10 is a perspective view of the strap assembled with partially cut-away platform 104 and ground contact 108 in a non-isolated configuration in accordance with the present disclosure.
Figure 11:
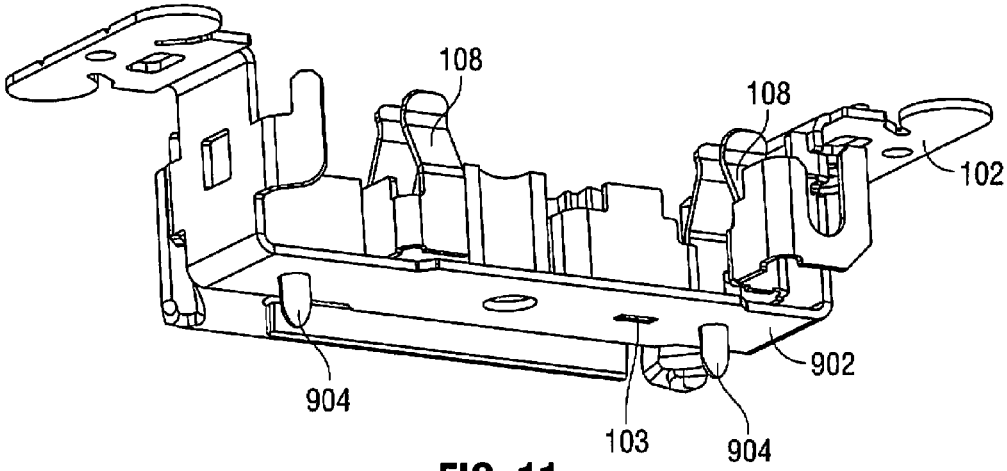
FIG. 11 is a perspective view of the strap assembled with partially cut-away platform 104 and ground contact 108 in an isolated configuration in accordance with the present disclosure.

FIGS. 10 and 11 show the strap 102, platform 104, and ground contact 108 with portions of platform 104 cut away. FIG. 10 shows a non-isolated ground configuration in which the ground contact 108 is electrically coupled to strap 102. Fingers 806 of ground contact 108 extend through aperture 103 formed in bottom surface 902 of strap 102 and electrically couple with strap 102. Accordingly, the ground contact 108 is coupled to the same ground that strap 102 is coupled to. FIG. 11 shows an isolated ground configuration in which fingers 806 have been removed from ground contact 108. Accordingly, the ground contact 108 is electrically isolated from the strap 102.

Method of Assembly of the Electrical Receptacle with Selectable Dual or Single Grounding The electrical duplex receptacle 100 having selectable traditional (i.e., non-isolated grounding) or isolated grounding is assembled by placing each of the phase contact 106*a* and neutral contact 106*b* in one of the compartments 204 of base 104 and placing ground contact 108 in compartment 206 of base 104. The placing of the phase contact 106*a* and neutral contact 106*b* and ground contact 108 includes loading them from the open top face of base 104 so that they rest on the floor 203 of base 104. This may be done by merely dropping each of the phase contact 106*a* and neutral contact 106*b* and ground contact 108 from the open top of the base 104 into the corresponding compartment. The dropping of the phase contact 106*a* and neutral contact 106*b* and the ground contact 108 into the base 104 can be performed by an automated machine. When use with a single ground is selected, the loading of the ground contact 108 includes inserting the protrusion 804 through apertures 212 of base 104 and aperture 103 of strap 102. The fingers 806 are deformed, e.g., by spreading fingers 806, in order to physically and electrically contact the strap and optionally to secure the ground contact 108 to strap 102. When use with an isolated ground is selected, the loading of the ground contact 108 is preceded by deforming the protrusion so that it does not protrude through aperture 212.

The first pair of contact screws 130 is secured to one of the phase contact 106*a* and neutral contact 106*b*, and the second pair of contact screws 130 is secured to the other of the phase contact 106*a* and neutral contact 106*b*. The ground contact screw 134 is secured to the ground contact 108. The base 104 is seated within strap 102 and rests on the bottom wall 118. Tamper resistant mechanism 110 is placed on top of base 104. Cover 112 is placed over tamper resistant mechanism 110 and secured to the strap 102 with center bushing 116.

It will be appreciated that features of the above-disclosed and other features and functions, or alternatives thereof, may be desirably combined into many other different systems or applications. For example, the present description is directed to a duplex electrical receptacle, but the above-disclosed features are applicable to single electrical receptacles or multiple electrical receptacles for accommodating more than two plugs. Also that various presently unforeseen or unanticipated alternatives, modifications, variations or improvements therein may be subsequently made by those skilled in the art which are also intended to be encompassed by the following claims. Additionally, the headings used are meant to assist the reader and are by no means limiting.

What is claimed:

1. An electrical contact for an electrical receptacle, the electrical contact comprising:

a main body;

a first segment that is an extension of the main body and substantially parallel to the main body;

a second segment coupled to the first segment and substantially perpendicular to the main body and the first segment;

a third segment coupled to the second segment and substantially perpendicular to the second segment and substantially parallel to the main body and the first segment;

a first wipe that extends from the first segment;

a second wipe that extends from the second segment; and a third wipe that extends from the third segment.

2. The electrical contact according to claim 1, wherein the first, second and third segments reside at a first end of the body, the electrical contact further comprising.

3. The electrical contact according to claim 1, further comprising:

a first bend disposed between the first and second segments; and a second bend disposed between the second and third segments.

4. The electrical contact according to claim 2, wherein the first and second bends are 90 degrees.

5. The electrical contact according to claim 1, wherein the first segment is bifurcated into an upper arm and a lower arm.

6. The electrical contact according to claim 5, wherein the first wipe extends from the upper arm and the lower arm is connected to the second segment.

7. The electrical contact according to claim 5, wherein the upper and lower arms branch from the main body.

8. The electrical contact according to claim 5, wherein the upper arm extends from the main body and bends toward the third segment.

9. An electrical contact for an electrical receptacle, the electrical contact comprising:

a main body;

a first segment that is the an extension of the main body and substantially parallel to the main body;

a second segment coupled to the first segment and substantially perpendicular to the main body and the first segment;

a third segment coupled to the second segment and substantially perpendicular to the second segment and substantially parallel to the main body and the first segment;

a first wipe that extends from the first segment;

a second wipe that extends from the second segment;

a third wipe that extends from the third segment;

a first bend disposed between the first and second segments; and a second bend disposed between the second and third segments, wherein the first and second bends are 90 degrees; and wherein the first segment is bifurcated into an upper arm and a lower arm that branch from the main body, the upper arm extends from the main body and bends toward the third segment, the first wipe extends from the upper arm, and the lower arm is connected to the second segment.

10. The electrical receptacle contact according to claim 1, further comprising a base adapted and configured to receive the electrical contact and to interfere with deflection of the first wipe for substantially limiting movement of the first wipe during insertion of a blade from an electrical plug without substantially limiting movement of either of the second and third wipes.

11. The electrical receptacle contact according to claim 1, wherein, the first wipe is substantially fixed throughout the insertion of a blade from an electrical plug.

12. The electrical receptacle contact according to claim 1, further comprising a base including at least one of a wall and a rib that interferes with movement of the first wipe during the insertion of a blade from an electrical plug, and wherein the first, second, and third wipes are adapted and configured to receive the blade in at least two orientations.

13. The electrical receptacle contact according to claim 1, further comprising a base including at least one of a wall and a rib that prevents the first wipe from moving during the insertion of a blade from an electrical plug.

14. The electrical receptacle contact according to claim 1, further comprising a base including includes at least one of a wall and a rib that constrains the first wipe so that at least a portion of the first wipe is substantially fixed during the insertion of a blade from an electrical plug.

15. The electrical receptacle contact according to claim 1, further comprising a base including a wall that interferes with movement of the first wipe during the insertion of a blade from an electrical plug for limiting movement of the first wipe, and wherein the base does not interfere with movement of the second and third wipes wipe during the insertion of the blade.

* * * * *